US006626326B2

(12) United States Patent
Murakami

(10) Patent No.: US 6,626,326 B2
(45) Date of Patent: Sep. 30, 2003

(54) VACUUM INSULATED CAN HOLDER

(75) Inventor: Yasuhiro Murakami, Roselle, IL (US)

(73) Assignee: Thermos L.L.C., Schaumburg, IL (US)

( * ) Notice: Subject to any disclaimer, the term of this patent is extended or adjusted under 35 U.S.C. 154(b) by 0 days.

(21) Appl. No.: 09/758,849

(22) Filed: Jan. 11, 2001

(65) Prior Publication Data

US 2002/0088810 A1 Jul. 11, 2002

(51) Int. Cl.[7] ..... B65D 25/00

(52) U.S. Cl. ..... 220/739; 220/23.87; 220/592.16; 220/592.27

(58) Field of Search ..... 220/23.87, 739, 220/484, 711, 592.27, 592.16, 592.17; 215/13.1

(56) References Cited

U.S. PATENT DOCUMENTS 998,490 A * 7/1911 Fitch ..... 220/23.87
3,941,237 A * 3/1976 MacGregor, Jr. ..... 198/690.1
4,721,216 A * 1/1988 Kinder ..... 215/393
4,747,507 A * 5/1988 Fitzgerald et al. ..... 220/739
4,974,741 A * 12/1990 Gustafson et al. ..... 206/486
5,022,549 A * 6/1991 Beaver ..... 220/484
5,573,140 A * 11/1996 Satomi et al. ..... 220/592.27
5,975,341 A * 11/1999 Schaeppi ..... 206/217
6,039,207 A * 3/2000 Adamek
6,119,888 A * 9/2000 Goto et al. ..... 215/13.1
6,155,452 A * 12/2000 Laurent ..... 220/711

* cited by examiner

*Primary Examiner*—Joseph M. Moy
(74) *Attorney, Agent, or Firm*—Wood, Phillips, Katz, Clark & Mortimer

(57) ABSTRACT

Difficulties in retaining can holders in conventional vehicular drink holders are eliminated in a vacuum insulated can holder that includes a cup-shaped metallic outer liner having an upper opening, an opposite bottom and a generally cylindrical side wall extending upwardly from the bottom to the opening. A similarly configured cup-shaped metallic inner liner is nested within the outer liner and spaced therefrom to define vacuum space between the two. The outer liner has an outer diameter just less than the inner diameter of a conventional vehicular beverage holder while the inner diameter of the inner liner is just greater than the outer diameter of a conventional metal beverage can.

6 Claims, 5 Drawing Sheets

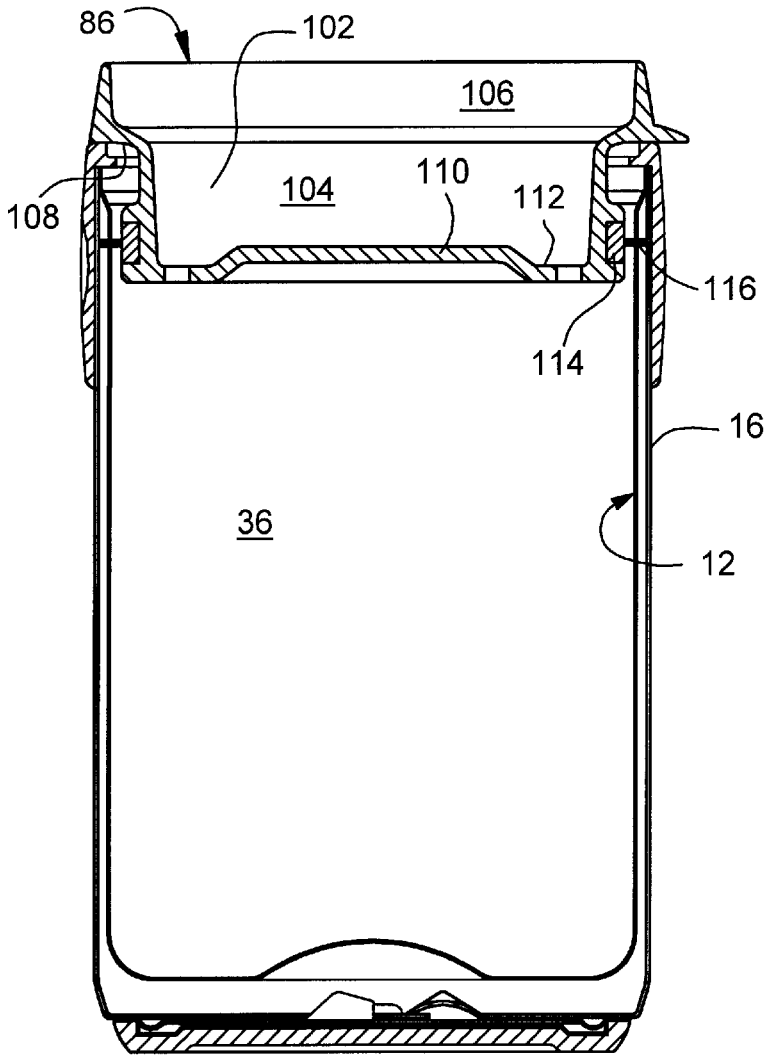
FIG 9
FIG. 10
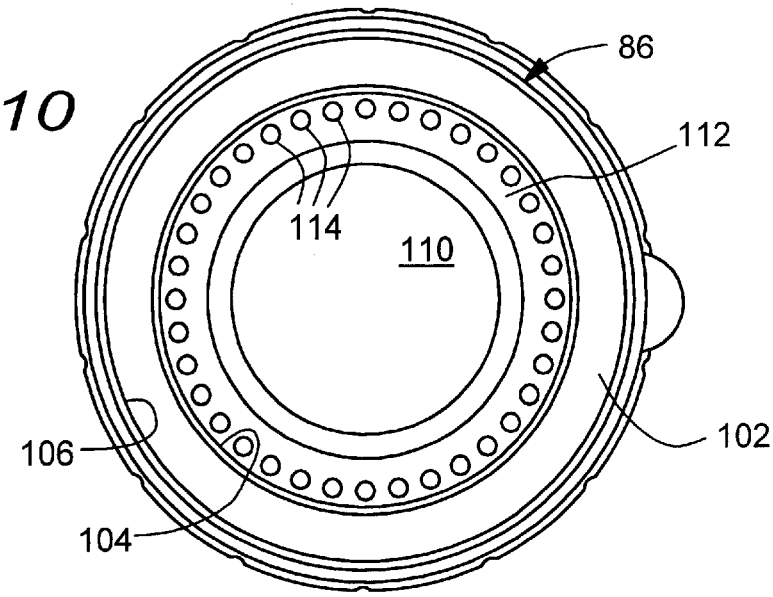

VACUUM INSULATED CAN HOLDER

FIELD OF THE INVENTION

This invention relates to a vacuum insulated can holder for holding conventional beverage cans to provide a measure of insulation from the ambient to prevent the contents of the can from undesirably warming or cooling at an undesirably rapid rate.

BACKGROUND OF THE INVENTION

Insulated beverage container holders have long been known. Conventionally, they are formed of a body of relatively soft, resilient, foam-like material that is formed with a cylindrical wall and a bottom and an upper opening. A can or bottle to be insulated from the ambient is introduced into the interior of the holder through the opening and frequently is firmly grasped therein because the resilience of the foam material and because the dimensions of the holder cause the same to frictionally grip the exterior of the can or bottle.

Unfortunately, typical constructions of the sort identified above as well as other types of known insulating can holders are bulky due to the wall thickness required to achieve insulating qualities. Consequently, they cannot fit easily into conventional vehicular mounted beverage holders or, if fitted thereinto, are partially compressed in the process, making it difficult to extract the can holder with the can therein from a vehicular drink holder.

Moreover, prior art beverage can holders have conventionally been single use type holders. That is to say, the holders are capable of being used for a single purpose, namely, holding a can or bottle and no other purpose or purposes.

When attempts have been made to form can holders of non-foam material, the problem of fitting such a holder to a conventional drink holder in a vehicle has remained. Moreover, often times the can to be contained in the beverage can holder fits loosely therein, allowing the can to move within the holder itself. In such a case, the possibility for spillage of the beverage is increased.

The present invention is directed to overcoming one or more of the above problems.

SUMMARY OF THE INVENTION

It is the principal object of the invention to provide a new and improved can holder for a conventional beverage can. More specifically, it is an object of the invention to provide an insulated can holder and even more specifically, a vacuum insulated can holder.

An exemplary embodiment of the invention achieves the foregoing object in a can holder that includes a cup-shaped, metallic outer liner having an upper opening, an opposite bottom and a generally cylindrical side wall extending upwardly from the bottom to the opening. Also included is a cup-shaped, metallic inner liner nested within the outer liner and again having an upper opening, an opposite bottom and a generally cylindrical side wall extending upwardly from the bottom to the opening.

The side wall of the inner liner is located radially inwardly of the side wall of the outer liner to define a space therebetween. Additionally, the bottom of the inner liner is located above the bottom of the outer liner to define a space therebetween. The cylindrical side walls of the inner and outer liners merge at the openings and are sealed thereat. A vacuum is pulled in the spaces and is maintained therein by the sealing between the inner and outer liners at the openings. At least the lowermost section of the outer liner has an outer diameter just less than an inner diameter of a conventional vehicular beverage holder while the inner diameter of the inner liner side wall is just greater than the outer diameter of a conventional metal beverage can.

As a consequence of the foregoing, a rigid can holder that is vacuum insulated is provided and which is sized to snugly receive a conventional beverage can while easily fitting in a conventional vehicular drink holder.

In a preferred embodiment, the lowermost outer diameter of the outer liner is just less than 2.890 inches.

A preferred embodiment also contemplates that the inner liner inner diameter be just greater than 2.600 inches.

A preferred embodiment also contemplates that the height of the inner liner cylindrical side wall be less than 4.840 inches.

In one embodiment, the inner liner cylindrical side wall includes at least one radially inwardly extending projection, the projection(s) having a height sufficient to engage a side of a conventional metal beverage can received in the inner liner.

In a highly preferred embodiment, the height of the projection(s) is sufficient to frictionally or resiliently grip a side of a conventional metal beverage can received in the inner liner.

In a highly preferred embodiment, there are a plurality of the projections.

A preferred embodiment also includes a grip ring on an uppermost part of the outer liner adjacent the outer liner opening.

In one embodiment, there is provided a cap that is removably attached to an uppermost end of at least one of the inner and outer liner cylindrical side walls. The cap includes an access opening alignable with the opening in a conventional metal beverage can.

In a highly preferred embodiment, the cap is provided with a crowned center having the alignable access opening and a depending skirt removably secured to one of the inner and outer liner cylindrical side walls.

In an even more preferred embodiment, the skirt includes a snap fit formation for securing the cap to the one of the inner and outer liner cylindrical side walls.

Even more preferably, the crowned center of the cap includes at least one spring finger directed toward the inner liner bottom so as to be engageable with the top of a can nested within the inner liner to hold the same firmly in place.

One embodiment of the invention contemplates that the outer liner cylindrical side wall include a step formed so that the lowermost section thereof has the outer diameter just less than the inner diameter of a conventional vehicular beverage holder.

Still another highly preferred embodiment of the invention contemplates the provision of a sipping lid received within the inner liner opening. The sipping lid has diametrically opposite openings. One of the openings defines a sipping opening and the other defines a vent opening.

In a preferred embodiment, the sipping lid has a sloping center with the sipping opening being located at a lowermost part of the sloping center and the vent opening being located at an uppermost part of the sloping center. An upstanding peripheral wall surrounds the sloping center.

Preferably, the sipping lid is formed of an elastomeric material and the upstanding side wall is sized and shaped to be removably, sealingly wedged into the inner liner opening.

The invention also includes the highly preferred form of a sipping lid to be received within the inner lining opening. In a preferred embodiment of the sipping lid, the same has a series of angularly spaced holes.

In a highly preferred embodiment of the sipping lid, the same includes an upstanding peripheral wall surrounding a center and a series of holes extends about the lid inwardly of the upstanding wall and outwardly of the center.

Preferably, the center is brazed and is connected to the upstanding wall by a depressed, peripheral trough with the openings located about the trough.

In a highly preferred embodiment, the sipping lid is formed of an elastomeric material and the upstanding wall is sized and shaped to be removably, sealingly wedged into the inner liner opening. Even more preferably, the upstanding wall extends an exterior, radially outward extending, peripheral sealing ridge which is wedged into the inner liner opening.

Other objects and advantages will become apparent from the following specification taken in connection with the accompanying drawings.

BRIEF DESCRIPTION OF THE DRAWINGS

FIG. 9 is a view similar to FIG. 7 but of a modified embodiment of the sipping lid; and FIG. 10 is a plan view of the sipping lid of FIG. 9.

DESCRIPTION OF THE PREFERRED EMBODIMENTS

Figure 1:
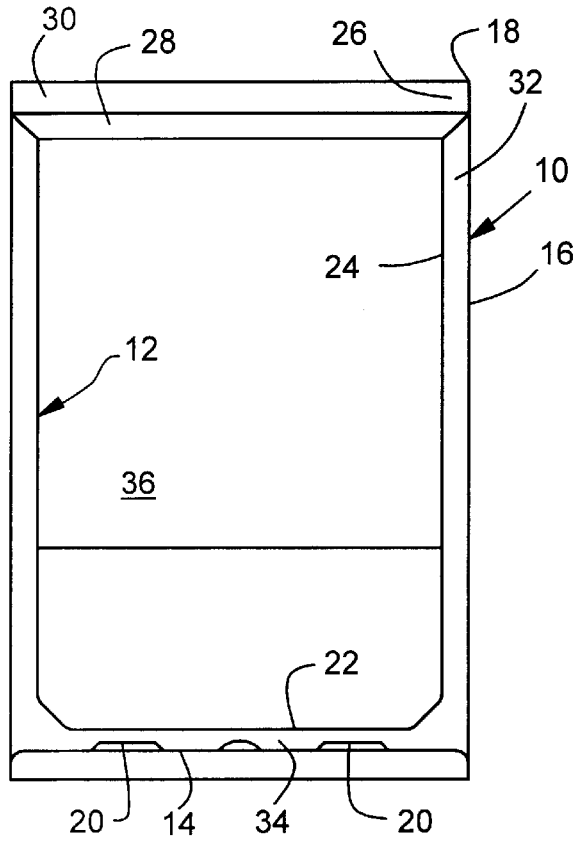
FIG. 1 is a vertical section of one form of a vacuum insulated can holder made according to the invention.

Referring to FIG. 1, a basic, exemplary embodiment of a can holder made according to the invention is illustrated. The same is seen to include an outer liner, generally designated 10 and an inner liner, generally designated 12. The liners 10 and 12 are formed of a metal, most typically stainless steel.

The outer liner 10 includes a bottom 14 welded or otherwise bonded to an upstanding, cylindrical side wall 16 which terminates in an upper opening 18. As illustrated in FIG. 1, the bottom 14 is formed separately from the side wall 16 and is bonded or welded thereto. However, as will be apparent from an inspection of FIGS. 2 or 3, for example, the bottom 14 and side wall 16 may be unitary.

Preferably, the bottom 14 includes a number of stiffening ribs or indentations 20.

The inner liner 12 is nested within the outer liner 10 and includes a bottom 22 and an upstanding, cylindrical side wall 24, also terminating in an opening 26. Again, the inner liner 12 may be formed of a side wall piece and a bottom piece or may be of unitary construction. As illustrated in FIG. 1, the side wall 24 includes a step 28 which expands to a radially outer peripheral edge 30 adjacent the opening 26.

It is to be particularly observed that the inner liner side wall 24 is thus spaced radially inwardly of the outer liner side wall 16 to define a space 32. Similarly, the bottom 22 of the inner liner 12 is located above and spaced from the bottom 14 of the outer liner 10 to form another space 34 which is in fluid communication with the space 32.

The peripheral flange 30 is sealed to the outer liner 18 adjacent the opening 18 therein as by welding after a vacuum has been pulled in the spaces 32, 34. Thus, the vacuum in such spaces is maintained by the sealing connection between the inner and outer liner at their openings 18 and 26 to ensure that the spaces 32, 34 provide an insulating space about the entire cavity 36 within the inner liner 12.

Figure 2:
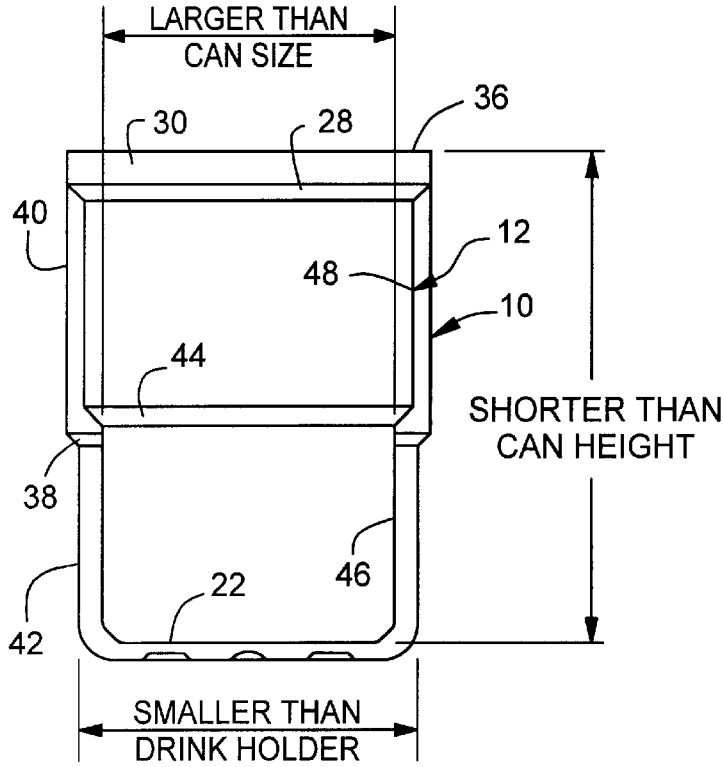
FIG. 2 is a vertical section of a modified embodiment of the invention.

According to the invention, and as illustrated by the legend shown in FIG. 2, the distance between the uppermost edge 36 of the assembly and the inner liner bottom 22 is less than that of a conventional metal beverage can. In a typical case, this will mean that the distance between the upper edge 36 and the bottom 22 of the inner liner 12 is less than 4.840 inches.

It will also be observed that the outer diameter of the outer liner 10, which is the part of the can holder that will fit in a conventional vehicular drink holder, has an outer diameter that is smaller than that of the drink holder. In the usual case, it will mean that the outer diameter of the outer liner 10 will be just less than 2.890 inches. In the embodiment illustrated in FIG. 1, this diameter is constant from top to bottom while in the embodiment illustrated in FIG. 2, the outer liner, intermediate its ends, is provided with a step 38 which divides the outer liner into a large diameter section 40 and a smaller diameter section 42, both of which are cylindrical. In the case of the embodiment illustrated in FIG. 2 having the step 38, it is only necessary that the smaller diameter section 42 be less than the inside diameter of a typical vehicular drink holder.

The inner diameter of the inner liner 24 is just greater than the diameter of a conventional metal beverage can. That is to say, it will be just greater than about 2.600 inches.

In some cases, the inner liner 12 may also be provided with a step 44 located intermediate its ends to divide the same into a small diameter section 46 and a larger diameter section 48 with the smaller diameter section 46 being lowermost. In this case, the inside diameter of the small diameter section 46 can be less than the diameter of a conventional metal beverage can while the large diameter section 48 will be just greater than the outside diameter of a conventional metal beverage can.

Figure 3:
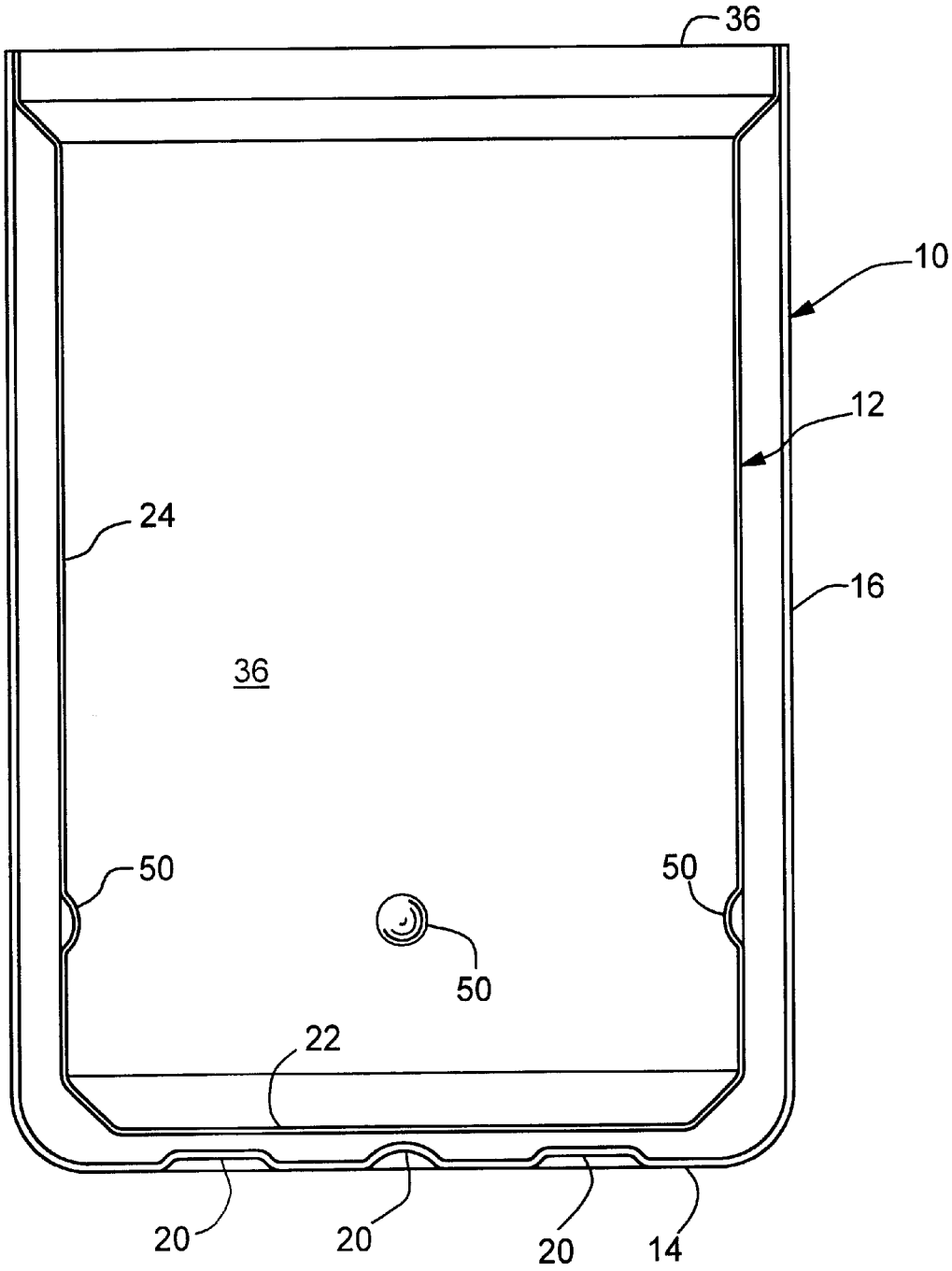
FIG. 3 is a vertical section showing still another form of the invention.

Turning now to FIG. 3, in some cases, it is desirable that the inner liner 12, usually near its lower end, be provided with radially inwardly extending projections in the form of dimples 50. In the usual case, a plurality of the dimples 50 will be used but it is contemplated that as few as one may be employed. In any case, it is preferred that the dimples 50 extend radially inwardly into the cavity 36 sufficiently to engage the side wall of a conventional metal beverage can disposed in the holder. Preferably, the extension of the dimples 50 into the cavity 36 is such as to frictionally or resiliently grip a side of a conventional metal beverage. Thus, if only one of the dimples 50 is used, the distance from the innermost point of the dimple 50 to the diametrically opposite part of the side wall 24 will be 2.600 inches or slightly less. For diametrically opposite dimples employed as illustrated in FIG. 3, the distance between the radially inner extent of the diametrically opposite dimples will then be 2.600 inches or slightly less.

In some instances, it is desirable to provide a cap for any of the beverage holders described thus far. When such is utilized, a small, peripheral bead 60 is located on the outer liner 10 to extend slightly radially outwardly therefrom at a location at or near the upper edge 36 of the assembly. A cap, generally designated 62, may be snap fitted to the bead 60 so as to be removably attached to the can holder itself. The cap 62 includes an upper, crowned center 64 surrounded by a depending skirt 66. At the lowermost end of the skirt 66, an inwardly turned, peripheral bead 68 is located to serve as a snap fit formation whereby the cap 62 may be snapped fit about the bead 60 on the can holder.

Figure 4:
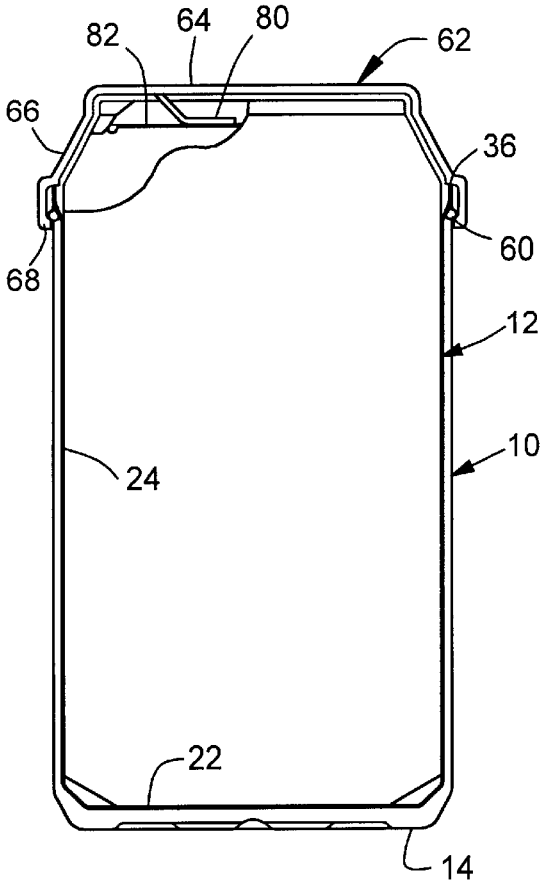
FIG. 4 illustrates an embodiment of the invention with a cap applied thereto.
Figure 5:
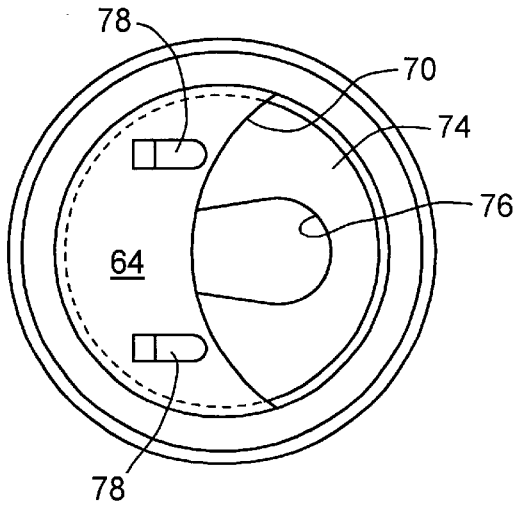
FIG. 5 is a plan view of the structure of FIG. 5.
Figure 6:
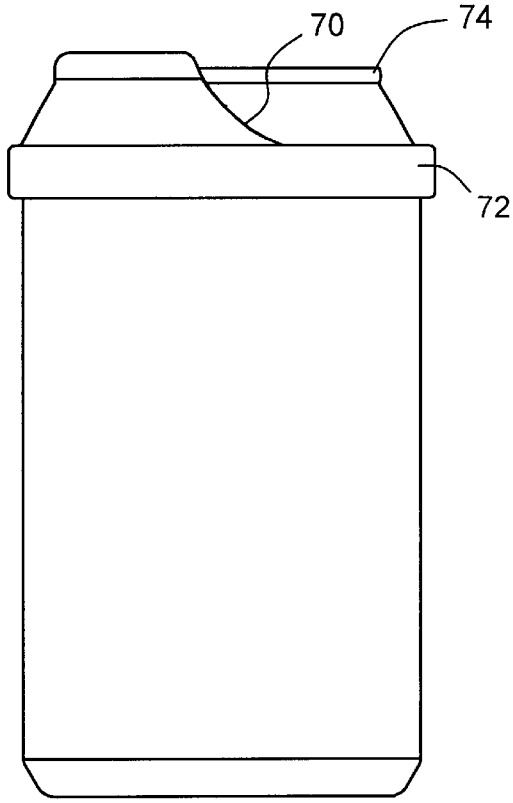
FIG. 6 is a side elevation of the form of the invention shown in FIGS. 4 and 5.

As illustrated in FIGS. 5 and 6, part of the crowned center 64 is cut away as illustrated at 70, as is part of the skirt 66, leaving only a lower, peripheral ring 72 having the snap fit bead 68 thereon. In this way, the upper end 74 of a conventional metal beverage can disposed in the cavity 36 (not shown in FIG. 4) and is accessible so that the conventional drink opening 76 in the can 74 is aligned with the opening 70 to be accessible to a user. Preferably, the remaining part of the crowned center 64 includes a pair of cut outs 78 which define L-shaped spring fingers 80 (FIG. 4) which extend downwardly toward the bottom 66. The spring fingers 80 may thus engage the top 82 of the can 74 to hold the same firmly in place within the can holder. Again, in this embodiment, the dimensions are generally as mentioned previously. It is to be specifically noted that, though not illustrated in FIG. 4, the projections 50 of FIG. 3 could also be used if desired.

Figure 7:
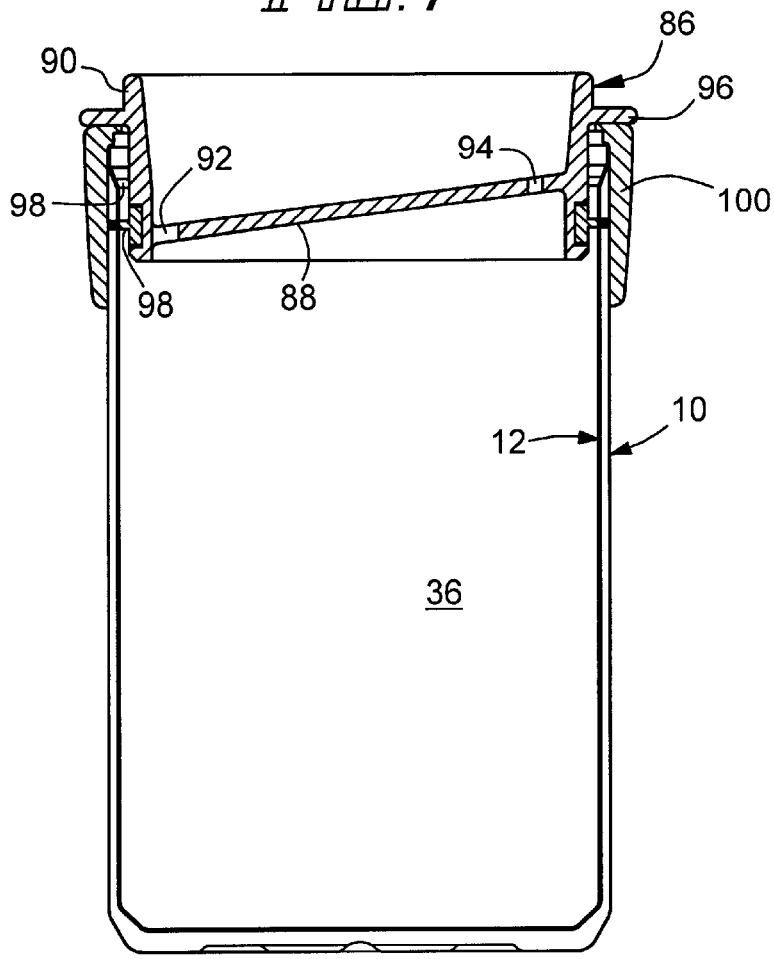
FIG. 7 is a vertical section of an embodiment of the invention including a sipping lid.
Figure 8:
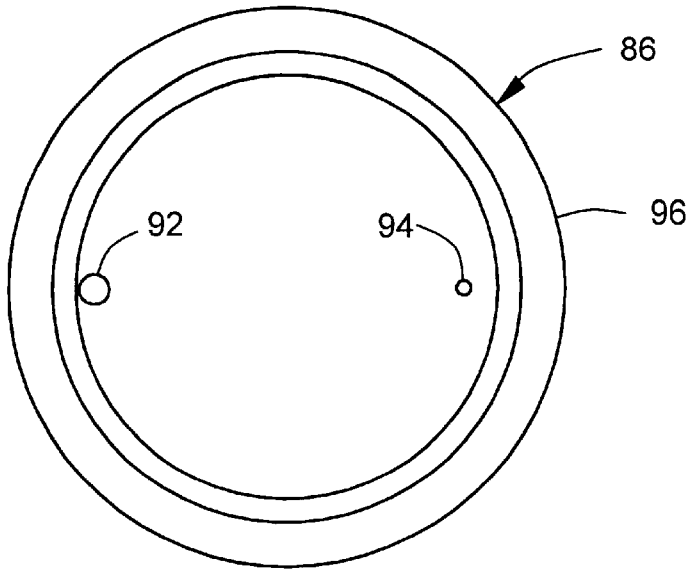
FIG. 8 is a plan view of the sipping lid.

FIGS. 7 and 8 show a further accessory for use with a can holder in the form of a sipping lid, generally designated 86. The sipping lid 86 includes a sloping center 88 surrounded by upstanding, peripheral wall 90. The sloping center 88 has a pair of openings shown at 92 and 94 therein. The opening 92 is relatively large and serves as a sipping opening wherein a beverage contained directly in the cavity 36 of the holder may be sipped. The smaller opening 94 serves as a vent opening to allow air to replace the beverage within the cavity 36 as it is withdrawn through the opening 92.

The upstanding wall 90 includes a peripheral, radially outwardly extending flange 96 which limits movement of the sipping lid 86 into the cavity 36. It is also provided with wiper seals in the form of peripheral, radially outwardly extending, flexible edges 98 which sealingly engage the inner liner 12 and allow the sipping lid 86 to be retained on the can holder by being wedged into the opening 26 in the inner liner 12. Thus, the sipping lid 86 may be grasped and removed to allow access to the cavity 36 which can then be used as the beverage container itself, providing a second use for the can holder, namely, a use as a cup per se for holding a beverage without the need for a beverage container separate from the can holder.

In general, to achieve the desired sealing affect as well as the wedging action for securing the sipping lid 86 to the can holder, it is preferred that the sipping lid 86 be made of a somewhat resilient elastomer.

FIG. 7 illustrates another preferred feature of the invention. A gripping ring 100 is disposed peripherally around, and secured to the outer liner 10 adjacent its opening 18. The securement may be obtained through the use of any suitable adhesive, an interference fit, etc.

FIGS. 9 and 10 illustrate a much preferred embodiment of the sipping lid 86. According to the embodiment of FIGS. 9 and 10, the sipping lid 86 includes a generally cylindrical, stepped, peripheral side wall 102 having a lower section 104 of reduced diameter and an upper section 106 of enlarged diameter. At the juncture of the two, a ledge 108 is present to limit movement of the sipping lid 86 toward the interior 36 of the can holder.

The sipping lid 86 of the embodiment illustrated in FIGS. 9 and 10 also includes a slightly raised, circular center 110 which is connected to the upstanding side wall by a somewhat depressed, peripheral trough 112. Within the trough 112 is a series of equally angularly spaced openings 114 which serve both as exit points for a beverage contained within the can holder and entrance points for venting air into the interior 36 of the can holder.

As best seen in FIG. 9, near its lower end, the reduced diameter section 104 of the peripheral wall 102 includes a peripheral, radially outwardly facing groove 114. Within the groove 114 is a band of an elastomer such as rubber or the like that includes a radially outwardly extending, flexible, sealing ridge 116. The ridge 116 flexibly, sealingly and removably, wedges sealing lid 86 within the opening of the inner liner 12.

From the foregoing it will be appreciated that a can holder made according to the invention achieves the objects set out for it. It provides excellent insulation for preventing a beverage from unduly rapidly heating or cooling as a result of ambient temperature, whether the beverage be contained in a conventional metal beverage can or whether it be introduced into the cavity 36 directly. The outer diameter of the can holder, at least at its lower end at the smaller diameter section 42, is sized to be received in a conventional drink holder in a vehicle while the cavity 36 is sized to snugly receive the conventional metal beverage can. The height of the drink holder is sized to allow a portion of a conventional beverage can disposed in the cavity 36 to project above the upper edge 36 of the can holder so that it may be readily gripped for the purpose of removing the same from the can holder. The grip ring 100 allows the user to obtain a firm grip on the beverage holder while the cap 62 provides a means for assuring positive containment of a can 74 within the cavity 36 while allowing access to the drink opening 76 of the can 74 and at the same time urging the can 74 downwardly within the cavity 36 to prevent shifting of the can therein. The projections 50, when used, provide much the same action, all contributing to a reduction in the possibility of spills.

The ability of the can holder to act as the beverage container itself is enhanced through the use of the sipping lid 86 when the can holder is not being employed in connection with a conventional metal beverage can.

What is claimed is:

1. A vacuum insulated can holder comprising:

a cup-shaped metallic outer liner having an upper opening, an opposite bottom and a generally cylindrical side wall extending upwardly from said outer liner bottom to said opening;

a cup-shaped metallic inner liner nested within said outer liner and having an upper opening, an opposite bottom and a generally cylindrical side wall extending upwardly from said inner liner bottom to said opening;

the cylindrical side walls of said inner and outer liners merging at said opening and being scaled thereat;

the side wall of said inner liner being located radially inward of the side wall of said outer liner to define a space therebetween;

the bottom of said inner liner being located above the bottom of said outer liner to define a space therebetween;

a vacuum in raid spaces and being maintained by the sealing between the inner and outer liners at said openings;

at least a lowermost section of said outer liner having an outer diameter lust less than an inner diameter of a conventional vehicular beverage holder;

the inner diameter of said inner liner side wall being just greater than the outer diameter of a conventional metal beverage can;

said lowermost outer diameter being less than 2.890 inches, said inner liner inner diameter being greater than 2.600 inches, and the height of said inner liner cylindrical side wall is being less than 4.840 inches.

2. A vacuum insulated can holder comprising:

a cup-shaped stainless steel outer liner having an upper opening, an opposite bottom and a generally cylindrical side wall extending upwardly from said outer liner bottom to said opening;

a cup-shaped stainless steel inner liner nested within said outer liner and having an upper opening, an opposite bottom and a generally cylindrical side wall extending upwardly from said inner liner bottom to said opening;

the cylindrical side walls of said inner and outer liners merging at said openings and being sealed thereat;

the side wall of said inner liner being located radially inward of the side wall of said outer liner to define a space therebetween;

the bottom of said inner liner being located above the bottom of said outer liner to define a space therebetween;

a vacuum in said spaces and being maintained by the sealing between the inner and outer liners at said openings;

at least a lowermost section of said outer liner having an outer diameter just less than 2.890;

the inner diameter of said inner liner side wall being just greater than 2.600 inches;

the height of said inner liner cylindrical wall being less than 4.840 inches.

3. The vacuum insulated can holder of claim 2 wherein said inner liner cylindrical side wall includes at least one radially inward extending projection(s), said projection(s) having a height sufficient to engage a side of a conventional metal beverage can received in the inner liner.

4. The vacuum insulated can holder of claim 3 wherein the height of said projection(s) is sufficient to frictionally or resiliently grip a side of a conventional metal beverage can received in the inner liner.

5. The vacuum insulated can holder of claim 3 wherein there are a plurality of said projections.

6. The vacuum insulated can holder of claim 2 further including a conventional metal beverage can located within said cup-shaped metallic inner liner in substantial engagement with said inner liner generally cylindrical side wall and said inner liner opposite bottom.

* * * * *